US005895505A

United States Patent [19]

Yamamoto et al.

[11] Patent Number: 5,895,505

[45] Date of Patent: Apr. 20, 1999

[54] DRY PROCESS FOR PREPARING INFORMATION-BEARING FIBROUS SHEETS BY HEAT TRANSFER PRINTING

[75] Inventors: Yasumasa Yamamoto, Otsu; Shiro Imai, Kyoto, both of Japan

[73] Assignee: Toray Industries, Inc., Tokyo, Japan

[21] Appl. No.: 08/087,674

[22] PCT Filed: Nov. 26, 1992

[86] PCT No.: PCT/JP92/01545

§ 371 Date: Jan. 10, 1994

§ 102(e) Date: Jan. 10, 1994

[87] PCT Pub. No.: WO93/11294

PCT Pub. Date: Jun. 10, 1993

[30] Foreign Application Priority Data

| | | | |
|---|---|---|---|
| Nov. 26, 1991 | [JP] | Japan | 3-310924 |
| Feb. 28, 1992 | [JP] | Japan | 4-043483 |
| Mar. 2, 1992 | [JP] | Japan | 4-044954 |

[51] Int. Cl.[6] ..... D06P 5/02

[52] U.S. Cl. ..... 8/471; 8/470; 8/933

[58] Field of Search ..... 8/445, 467, 470, 8/471, 922, 933, 934; 428/914; 427/148, 375, 379, 381

[56] References Cited

U.S. PATENT DOCUMENTS

| | | | |
|---|---|---|---|
| 4,115,053 | 9/1978 | Aeschlimann | 8/544 |
| 4,163,642 | 8/1979 | Bauer et al. | 8/2.5 A |
| 4,960,871 | 10/1990 | Hihara et al. | 8/549 |
| 4,968,659 | 11/1990 | Nishitani | 8/471 |
| 4,997,452 | 3/1991 | Kovach et al. | 8/471 |
| 5,011,815 | 4/1991 | Beck et al. | 8/471 |
| 5,126,390 | 6/1992 | Duff | 524/276 |

FOREIGN PATENT DOCUMENTS

| | | |
|---|---|---|
| A 50-94284 | 7/1975 | Japan . |
| 51-143539 | 12/1976 | Japan . |
| A 57-117683 | 7/1982 | Japan . |
| 58-188691 | 11/1983 | Japan . |
| A 61-231286 | 10/1986 | Japan . |
| 62-211194 | 9/1987 | Japan . |
| 63-036663 | 2/1988 | Japan . |
| 3234860 | 10/1991 | Japan . |

OTHER PUBLICATIONS

English translation of JP–48–4789, Connor et al., Jan. 22, 1973.

*The Chemistry of Synthetic Dyes*, vol. III, Edited by K. Venkataraman, Chapter VIII, 1970.

*Primary Examiner*—Paul Lieberman

*Assistant Examiner*—Caroline L. Dusheck

*Attorney, Agent, or Firm*—Armstrong, Westerman, Hattori, McLeland & Naughton

[57] ABSTRACT

The present invention relates to a process for printing characters or image with high durability on a fibrous sheet by a dry method, fabrics prepared by said printing process, and an apparatus for preparing said fabrics. The present invention relates to a process for preparing an information-bearing fibrous sheet, comprising the steps of temporarily forming an image such as characters or identification mark on a fibrous sheet by a dye; heating it to let the dye migrate into the fibrous sheet; and pressing another sheet material to the fibrous sheet with the image temporarily formed, with heat treatment for removing the excessive dye. The process of the present invention does not include the step of washing by water and allows dyeing with a sense of OA apparatuses. Therefore, it can be widely applied for clothing, and industrial and fashion fabric goods, etc. and expected to tempt the development of quite new applications.

8 Claims, No Drawings

DRY PROCESS FOR PREPARING INFORMATION-BEARING FIBROUS SHEETS BY HEAT TRANSFER PRINTING

TECHNICAL FIELD

The present invention relates to a process for printing such information as characters, images or identification marks, etc. on a fibrous sheet (fibrous fabric) such as a woven, knitted or non-woven fabric, and also to the information-bearing fabrics prepared by the process, and an apparatus for preparing the information-bearing fabric.

BACKGROUND

To record such information as characters, images or identification marks, etc. on a fabric, so-called textile printing by use of a dye or pigment has been practiced for keeping good washing resistance, wear resistance, etc. However, textile printing requires a printing plate for each pattern and is very poor in flexibility to entertain changes of images. When information-bearing fabrics of various kinds are produced in respectively small quantities, for example, when serial numbers changing each time of recording are printed, it can be generally said that such textile printing cannot be used at all.

Considering the above flexibility, various printers used for OA apparatuses are very promising. These printers include heat transfer printers, impact printers, electrophotographic printers, ink jet printers, sublimation type heat sensitive transfer printers, etc. Among them, the former three printers use mainly pigments as coloring agents. However, in the combination of a pigment and a fabric, even though an image can be formed temporarily by a pigment on a fabric, washing, friction, etc. easily deprive the fabric of the pigment, and so these printers cannot be said to be suitable for fabrics. On the other hand, the latter two printers are described below in detail.

For the ink jet printer, a method of printing an ink containing a dye and heating it for dyeing has begun to be studied for application of the printer to fabrics. However, since the ink is liquid, printing on a fabric not treated at all causes blurring, thereby not allowing a clear image to be obtained. So, before printing, the fabric must be treated to prevent blurring thereby raising the cost disadvantageously. Even if the additional cost of treating the fabric for preventing blurring is disregarded, all the dye applied is not fast deposited on the fabric, and some of the dye remains loose to pose a serious problem in view of fastness to friction, recontamination, etc.

On the other hand, in the case of sublimation type heat sensitive transfer printer, a sublimable dye is used, and the treatment of the fabric for preventing blurring is not required unlike the ink jet printer. So, the printer seems to be preferable. However, the sublimation type heat sensitive transfer printer uses a very highly sublimable dye to keep the heating temperature lower, since the thermal head used in the printer becomes shorter in life if the heating temperature is higher. If such a very highly sublimable dye is used for dyeing the fabric, it is low in fastness to washing, ironing, etc., and the conventional sublimation type heat sensitive transfer printer cannot be immediately applied to fabrics. The sublimation type heat transfer technique can be used for printing fabrics if the dye used is good in fastness, but such a dye good in fastness cannot be used in view of the life of the thermal head since it is high in sublimation temperature.

As described above, any of conventional printing techniques cannot provide images excellent in washing resistance and wear resistance, with flexibility to changes of images at low running cost.

In addition to the above problems, the printers other than the ink jet printer require the recording medium to be smooth on the surface, and so the problem must overcome that ordinary fabrics are very poor in surface smoothness compared to paper, etc.

DISCLOSURE OF THE INVENTION

The present invention provides a printing technique for fabrics, which satisfies all of flexibility to changes of images, washing resistance and wear resistance of printed images and low running cost.

For recording images on fabrics, the use of a dye is most preferable in the present situation, in view of washing resistance and wear resistance. Furthermore, also considering the flexibility to changes of images, the sublimation type heat transfer technique uses a highly sublimable dye, and since most of the present recording paper materials use a porous polyester resin as the surface layer, the technique is apparently surmised to be highly compatible with a fabric as a recording medium, especially a polyester fabric. However, since a sublimable dye is used, repeated washing and ironing deprive the fabric of the dye. To avoid this phenomenon, that is, to improve the fastness of the dye, it is very effective to use a dye higher than a present dye in sublimation temperature. And yet, the present sublimation type heat sensitive transfer printer uses a highly sublimable dye, since a higher heating temperature shortens the life of the thermal head.

The inventors studied intensively how to flexibly form images on fabrics using a dye high in sublimation temperature and excellent in fastness, and considered to apply a heat transfer printer or impact printer which now uses a pigment as the coloring agent. They found that if a ribbon mainly containing a dye high in sublimation temperature is used in such a printer instead of the conventional ink ribbon, to form a temporary image on a fabric and another sheet material is pressed against the fabric, for absorbing the excessive dye by heating, then the dye can be well fast deposited in the fibers constituting the fabric, to achieve practically sufficient fastness to friction.

Since the excessive dye remaining loose after fast dye deposition remarkably worsens the fastness to friction, it has been practiced to remove it by using an aqueous material, for example, by reduction washing. In the present invention, a dry method is used instead of it, to allow the production of an information-bearing fabric. This also overcomes the poor fastness to friction which has also be a problem with ink jet dyeing.

As for the timing of heating with a sheet material pressed against the fabric, the heating can be effected after the image of information temporarily formed on the fabric by a coloring agent mainly composed of a dye has been heated to be transferred into the fabric, or can be effected after the sheet material has been pressed against the fabric with the image temporarily formed. In the former case, the dye can be efficiently fast deposited in the fibers of the fabric, and in the latter case, heating is required only once. So, either can be selected as required.

For forming an image of a dye on a fabric, a temporary image can be formed on a sheet such as paper or polyester film by a printer using an ink or ink ribbon, etc. containing the dye, and the sheet can be pressed against the fabric with heating, to fast deposit the dye into the fibers constituting the fabric, based on the above concept. Also in this case, the method of removing the excessive dye can be applied.

The sheet material used for removing the excessive dye from the fabric can be any material, but a sheet substantially made of a polyester or polyolefin can be preferably used since it is liable to absorb the excessive dye. Furthermore, a cellulose based compound such as paper can also be used. In this case, the running cost can be low, and especially for forming the temporary image by heat transfer method, the cellulose based compound can be preferably used.

If the sheet material is a film, since it is good in adhesion to the fabric, it is liable to absorb the excessive dye, and so can be preferably used.

In the present invention, the heating method for letting the dye migrate into the fibers and for removing the excessive dye is not especially limited, but in view of heat transfer efficiency, heating in water vapor atmosphere is preferable. Furthermore, from the viewpoint of miniaturization as pursued in OA apparatuses, heating by hot air is also preferable. Anyway, pressurization using a hot roller, etc. is also preferable in view of heat transfer efficiency, and can be preferably used especially for heating by hot air. For pressurization by a hot roller, etc., the hot roller, etc. may be provided for this particular purpose only, but if a hot roller, etc. is used, for example, for bonding a hot melt type adhesive film or fabric to the fabric with a temporary image formed, the hot roller, etc. can be preferably used also for the particular purpose.

The dye used in the present invention can be a disperse dye or basic dye, etc., and is not especially limited in kind, but should be preferably a sublimable dye with a sublimation temperature of 180° C. to 300° C., more preferably 200° C. to 250° C. In short, it is preferable to use a dye with high fastness. In the present invention, the sublimation temperature refers to the temperature at which the vaporization pressure of the sublimable dye (sublimation pressure) becomes equal to the external pressure.

In the new method for forming an image on a fabric as described above, a heat transfer printer or impact printer, etc. is used for forming a temporary image, and so a fabric with a smooth surface can be preferably used, for obtaining a clear temporary image. However, conventional fabrics are very poor in surface smoothness compared to paper, etc. and therefore very low in transfer efficiency. If an ink jet printer is used, the fabric is not necessarily required to have a smooth surface, but a fabric treated to prevent blurring can be preferably used.

In the present invention, the recording medium used can be preferably a woven or knitted or nonwoven fabric mainly composed of extra fine fibers of 0.0001 to 1 denier, more preferably 0.0005 to 0.3 denier, furthermore preferably 0.001 to 0.1 denier in single fiber size. Such a fabric is good in surface smoothness, and a temporary image can be formed with clearness substantially equivalent to that achieved on paper, using a heat transfer printer, impact printer or ink jet printer, etc. Especially a fabric composed of extra fine fibers with polyamide fibers and polyester fibers well mixed is preferable since it has a surface excellent in compactness, thus smoothness. It is also preferable to treat the surface of the fabric by water jet punching, for opening and/or intertwining the extra fine fibers, to make the surface more compact. Such treatment also remarkably improves the form stability of the fabric. Furthermore, calendering is also very preferable since it improves the surface smoothness and make the fibers more intertwined to achieve higher dimensional stability.

The method for preparing the above extra fine fibers is not especially limited, and various conventional extra fine fiber production techniques can be applied as they are.

The cross sectional form of the fibers is not limited to be circular, but can also be triangular, square, rectangular, ellipsoidal or polygonal. Rather, ellipsoidal or rectangular fibers looking flat can be said to be preferable since the surface smoothness is better than that of other formed fibers with the same single fiber size.

When the fabric is woven or knitted, the numbers of threads of warp and weft, the number of fibers constituting each thread and the weaving or knitting densities are important factors for achieving the effect of the present invention preferably. The product obtained by multiplying the numbers of the fibers constituting warp and weft should be preferably 5,000,000 or more per square centimeter, and the product obtained by multiplying the weaving or knitting densities of warp and weft threads should be preferably 1,000 or more per square centimeter. Especially when these values are satisfied, the dyeing efficiency of the dye sublimed from the temporary image formed on a woven or knitted fabric to the woven or knitted fabric is very good, and a very practical optical density and a clear pattern boundary of the image can be obtained.

Similarly, also a nonwoven fabric should be preferably very compact and as flat as possible in surface structure. Concretely, the inventors found that a fabric of 0.15 g/cm$^3$ or more in apparent density is preferable, though this is not restrictive. Therefore, for example, a spun bond nonwoven fabric or short-fiber nonwoven fabric treated by calendering or water jet punching can be preferably used. The apparent density in the present invention refers to the value expressed by the following formula:

$$\text{Apparent density (g/cm}^3\text{)=Unit weight (g/cm}^2\text{)/Thickness (cm)}$$

The present invention also provides an apparatus, based on the above mentioned concept, for preparing an information-bearing fabric, comprising a printer section for forming a temporary image by a coloring agent mainly composed of a dye on a fabric by at least the heat transfer technique, ink jet printing technique or impact printing technique, a section for heat-treating the fabric, and a section for pressing a sheet material against the heat-treated fabric for heat treatment. Furthermore, it is preferable that a fabric carrier is provided in addition. In this case, it is preferable that the printer section, the section for heat-treating the fabric, and the section for pressing a sheet material for heat treatment are arranged in series in the fabric carrying direction. Moreover, it is preferable that the section for heat-treating the fabric is substantially the same as the section for pressing a sheet material against the heat-treated fabric for heat treatment.

Said heat transfer printer, impact printer or ink jet printer, etc. usually refers to a printer which is controlled and has information applied by an external computer, etc. when it prints such information as characters, image or identification mark, etc. However, in addition to this function as a so-called printer, it is preferable that the printer has an optical reader so that it can print at the printer section the image, etc. read by the reader as it is or after editing or processing. This function allows any optional image, etc. to be easily printed on a fabric, and furthermore in combination with the editing function, can variously process the original image for printing. The editing and processing functions basically include, but are not limited to, a scaling function to enlarge or reduce an original image in a given two-dimensional rectangular coordinate system in the respective axial directions at the same or different rates, a function to cut out a part of the original image, a function to erase the portions with an area or a number of picture elements larger or smaller than any specified value, a function to change the contrast, a reversing function, a function to convert into a mosaic pattern, etc. It is also preferable to combine these functions properly. It is also preferable to use plural dyes for printing an image, etc. in multi-color or full color. In this case, it is also preferable to add a function to convert a designated color into another color, to the above functions.

PREFERRED EMBODIMENTS OF THE INVENTION

The present invention is described below in more detail in reference to examples, but the validity and right of the present invention are not limited thereto or thereby.

The fabric used in the following examples, to have an image printed, was an image-recording fabric smooth and compact on the surface prepared by treating a high density fabric composed of extra fine polyester filaments of 0.06 denier by water jet punching, and subsequently calendering.

EXAMPLE 1

The image-recording fabric was lined with a thick polyester film, and set in a marketed heat transfer printer, and printed using a heat transfer ribbon mainly containing a dye high in sublimation temperature.

The image (temporary image) obtained by the above operation was peeled when partially rubbed, to confirm that it was far from being resistant against washing and friction.

So, the fabric with the temporary image formed was fed in contact with a hot roller, to let the dye in the temporary image migrate into the fibers constituting the fabric.

The image was partially rubbed by wet cotton fabric, and the excessive dye not fast deposited was caught by the cotton fabric, to confirm that since the excessive dye had remained on the fabric, the image was poor in fastness to friction.

Subsequently, paper was overlapped on the fabric, and they were fed in contact with a hot roller again, to catch the excessive dye by the paper for removal.

The dyed image thus obtained was rubbed by wet cotton fabric, but it did not happen that the cotton fabric was contaminated by the excessive dye. Furthermore, even if washing and ironing were repeated, the clear image was confirmed to remain.

EXAMPLE 2

The image-recording fabric was treated to prevent blurring, and printed with a bar code using an ink mainly composed of a dye high in sublimation temperature by an ink jet printer.

The fabric with the bar code printed as a temporary image by the above operation had a 130 μm thick biaxially oriented polyester film overlapped on the surface, and they were hot-pressed at 180° C. for 1 minute, to let the dye in the temporary image migrate into the fibers constituting the fabric and to let the polyester film absorb the excessive dye.

The dyed bar code image thus obtained was rubbed by wet cotton fabric, but not caught by it, to confirm that the rubbed bar code could be well read at high reproducibility. This showed that even without effecting reduction washing, etc. for removing the excessive dye, there arose no practical problem.

For comparison, the printed fabric was hot-pressed without overlapping the polyester film. When the image was rubbed by wet cotton fabric, the excessive dye not fast deposited was caught by the cotton fabric, and furthermore on the contrary, the bar code-recorded fabric was contaminated, not allowing the bar code to be read.

Moreover, unexpectedly, when the printed fabric was repeatedly hot-pressed without overlapping the Polyester film, the dye was transferred to the pressing face of the press and re-transferred to the recording medium. It was found that the phenomenon could also be prevented by the present invention.

Industrial Applicability

The process of the present invention for preparing an information-bearing fibrous sheet can be widely applied for clothing, and industrial and fashion fabric goods, etc.

The present invention is a timely dyeing method which could not be thought of according to conventional techniques, and allows dyeing with a sense of OA apparatuses. Therefore, it is expected to tempt the development of quite new applications.

We claim:

1. A dry process for preparing an information-bearing fibrous sheet, comprising the steps of:

(a) forming a temporary, non-fast image on a fibrous sheet with a coloring agent composed of a sublimable dye having a sublimation temperature of 180° C. to 300° C., the temporary image being formed by heat transfer printing directly on the fibrous sheet with a heat transfer printer having a heat transfer ribbon containing the sublimable dye and a heated printing head; and (b) subjecting the fibrous sheet to a combination of (i) heating to allow the dye to migrate into the fibrous sheet to form a fast-deposited image, and (ii) pressing another sheet material onto the fibrous sheet with a roller or hot plate, while heating, in order to remove excess dye, said heating being conducted by a dry process, said method not including any step of washing said fibrous sheet with an aqueous composition.

2. A process for preparing an information-bearing fibrous sheet according to claim 1, wherein said another sheet material comprises a polyester or polyolefin.

3. A process for preparing an information-bearing fibrous sheet according to claim 1, wherein said another sheet material is made of a cellulose based compound.

4. A process for preparing an information-bearing fibrous sheet according to claim 1, wherein said another sheet material is a film.

5. A process for preparing an information-bearing fibrous sheet according to claim 1, wherein said another sheet material is paper.

6. A process for preparing an information-bearing fibrous sheet according to claim 1, wherein, during heating of the fibrous sheet to let the dye migrate into the fibrous sheet, a pressure is applied to the fibrous sheet.

7. A dry process for preparing an information-bearing fibrous sheet, according to claim 1, wherein the fibrous sheet is composed of polyester fibers.

8. A dry process for preparing an information-bearing fibrous sheet, according to claim 1, wherein the fibrous sheet is composed of extra fine fibers of 0.0001 denier to 1 denier in single fiber size.

* * * * *